US009985343B2

(12) United States Patent
Talty et al.

(10) Patent No.: US 9,985,343 B2
(45) Date of Patent: May 29, 2018

(54) OPTIMAL CAMERA AND ANTENNA INTEGRATION

(71) Applicant: GM GLOBAL TECHNOLOGY OPERATIONS LLC, Detroit, MI (US)

(72) Inventors: Timothy J. Talty, Beverly Hills, MI (US); Norman J. Weigert, Whitby (CA); Duane S. Carper, Davison, MI (US); Caroline Chung, Royal Oak, MI (US); Wende Zhang, Troy, MI (US); Thomas A. Seder, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 78 days.

(21) Appl. No.: 15/220,132

(22) Filed: Jul. 26, 2016

(65) Prior Publication Data

US 2017/0033449 A1 Feb. 2, 2017

Related U.S. Application Data

(60) Provisional application No. 62/198,464, filed on Jul. 29, 2015.

(51) Int. Cl.

| | |
|---|---|
| ***H01Q 1/32*** | (2006.01) |
| ***H01Q 15/02*** | (2006.01) |
| ***H01Q 21/28*** | (2006.01) |
| *H01Q 9/42* | (2006.01) |

(52) U.S. Cl.
CPC ..... *H01Q 1/3275* (2013.01); *H01Q 21/28* (2013.01); *H01Q 9/42* (2013.01)

(58) Field of Classification Search
CPC .... H01Q 1/3275; H01Q 15/02; H01Q 1/2291; H01Q 21/28; H01Q 9/42; H01Q 1/32
See application file for complete search history.

(56) References Cited

U.S. PATENT DOCUMENTS

| | | | | |
|---|---|---|---|---|
| 2002/0003571 | A1* | 1/2002 | Schofield | B60C 23/00 348/148 |
| 2003/0202097 | A1* | 10/2003 | Kallhammer | B60R 1/00 348/148 |
| 2009/0086015 | A1* | 4/2009 | Larsen | F41G 3/165 348/46 |

* cited by examiner

*Primary Examiner* — Tho G Phan
(74) *Attorney, Agent, or Firm* — John A. Miller; Shumaker, Loop & Kendrick, LLP

(57) ABSTRACT

An antenna module mounted to a roof of a vehicle that includes a plurality of antenna elements for various vehicle communications systems. The antenna module also includes an FDM camera associated with an FDM, where the camera is positioned at the rear of the module and is mounted in a general flat configuration parallel to the roof the vehicle so that the camera field-of-view is directed upward and so that metal components of the camera do not interfere with the radiation pattern of the antenna elements. The camera includes one or more optical elements, such as a prism or reflector, mounted to the camera or other structure that redirects the camera field-of-view rearward of the vehicle.

20 Claims, 2 Drawing Sheets

OPTIMAL CAMERA AND ANTENNA INTEGRATION

CROSS-REFERENCE TO RELATED APPLICATIONS

This application claims the benefit of the priority date of U.S. Provisional Patent Application Ser. No. 62/198,464, titled, Optimal Camera and Antenna Integration, filed Jul. 29, 2015.

BACKGROUND OF THE INVENTION

Field of the Invention

This invention relates generally to an integrated antenna assembly and full display mirror (FDM) camera module and, more particularly, to an integrated vehicle roof mounted antenna assembly and FDM camera module, where the camera module is positioned so that it is pointing upward and does not interfere with the radiation pattern of any of the antenna elements in the assembly, and where the camera module includes an optical element that redirects the image plane of the module behind the vehicle.

Discussion of the Related Art

Conventional vehicles include an internal rear-view mirror mounted to a center location of the vehicle windshield. When a driver of the vehicle looks into the rear-view mirror to see objects behind the vehicle, various things inside the vehicle, such as seat headrests, passengers, etc., block some of the view provided by the mirror. It has been proposed in the art to replace the traditional rear-view mirror of a vehicle with a full display mirror (FDM) that is coupled to a rearward facing camera on the vehicle that provides an image displayed on the mirror. The displayed image provided by the camera typically has a wider field-of-view than the mirror, and is not obstructed by anything in the vehicle. The FDM can be put in a camera mode where the image from the camera is displayed on the mirror or in a reflective mode where the traditional rear-view from the mirror is provided. Thus, if the camera is blocked by dirt, snow, etc., or malfunctions, the vehicle operator can switch to the reflective mode for viewing objects behind the vehicle.

Modern vehicles typically include a back-up camera generally mounted proximate the back license plate on the vehicle that provides images to a display on the vehicle when the vehicle is in reverse. However, a number of issues, such as safety concerns, government regulations, etc., do not allow the traditional back-up camera on a vehicle to be used as an FDM camera. Further, the field-of-view of the back-up camera is generally significantly more limited than what is necessary for an FDM camera. Thus, a separate camera is necessary for an FDM in addition to the back-up camera. It has been proposed in the art to position the FDM camera adjacent to or proximate to the back-up camera. However, this area of a vehicle is typically susceptible to dirt, mud, snow, ice, etc., which obscures the lens of the FDM camera, and often prevents it from being usable.

Modern vehicles employ various and many types of antennas to receive and/or transmit signals for different communications systems, such as terrestrial radio (AM/FM), cellular telephone, satellite radio, dedicated short range communications (DSRC), GPS, etc. Often the antennas used for these systems are integrated in a common antenna module that is mounted to a roof of the vehicle so as to provide maximum reception and transmission capabilities.

It has been proposed in the art to integrate an FDM camera in a vehicle roof mounted antenna module so that the camera is pointing rearward of the vehicle proximate the vehicle roof line, which is similar to the normal view of the rear-view mirror. This location for an FDM camera benefits from the aerodynamic configuration of the antenna module in that wind direction and pressure differentials prevent significant dirt accumulation at the backend of the antenna module, and thus does not obscure the camera lens.

A typical FDM camera will include relatively large metal components to which the camera circuit board, power supply and other camera structures are mounted. Because the FDM camera needs to be pointing rearward of the vehicle, these metal structures are typically configured in a vertical direction, perpendicular to the plane of the vehicle roof. In this configuration, the metal structures in the camera often times interfere with the radiation pattern of all or most of the antenna elements in the antenna module, thus impacting antenna performance. Particularly, the antenna elements are unable to operate in a complete omni-directional manner to receive and transmit signals from all directions around the vehicle.

SUMMARY OF THE INVENTION

The present disclosure describes an antenna module mounted to a roof of a vehicle that includes a plurality of antenna elements for various vehicle communications systems. The antenna module also includes an FDM camera associated with an FDM, where the camera is positioned at the rear of the module and is mounted in a general flat configuration parallel to the roof the vehicle so that the camera field-of-view is directed upward and so that metal components of the camera do not interfere with the radiation pattern of the antenna elements. The camera includes one or more optical elements, such as a prism or reflector, mounted to the camera or other structure that redirects the camera field-of-view rearward of the vehicle.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a roof mounted antenna module for a vehicle including an FDM camera is merely exemplary in nature, and is in no way intended to limit the invention or its applications or uses. For example, the discussion below refers to the vehicle as being an automobile. However, as will be appreciated by those skilled in the art, the vehicle can be other vehicles, such as motorcycles, ebikes, trains, airplanes, etc.

Figure 1:
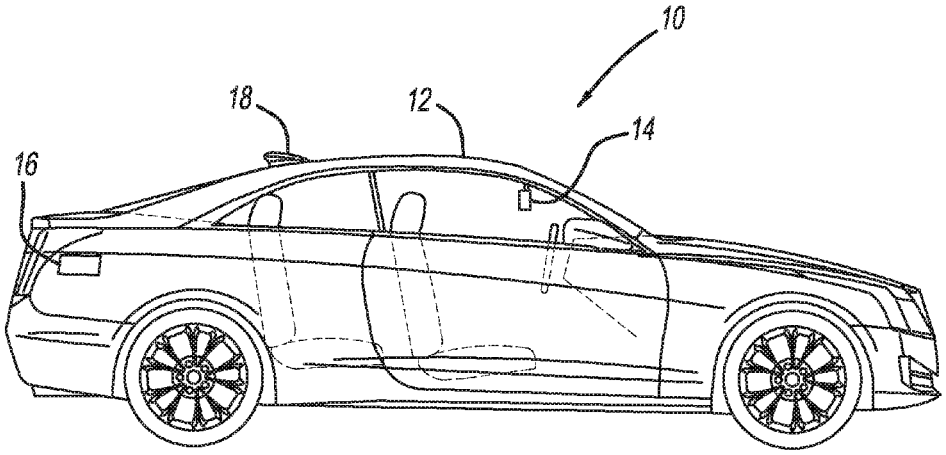
FIG. 1 is a side-view illustration of a vehicle including a roof mounted antenna module.

FIG. 1 is a side-view illustration of a vehicle 10 including a vehicle roof 12 and an FDM 14. The FDM 14 is the type discussed above that can be switched between a traditional reflective mode and a camera mode that provides a display from a camera rearward of the vehicle 10. A processor 16 is part of the FDM 14 and is intended to represent all of the processing and circuit components necessary for the FDM operation, where the processor 16 can be located at any suitable location on the vehicle 10 including on the FDM 14. The vehicle 10 includes a roof mounted antenna module 18 that includes any combination or configuration of antenna elements for a particular vehicle communications architecture as will be discussed in further detail below, and could include an FDM camera that provides images to the FDM 14.

Figure 2:
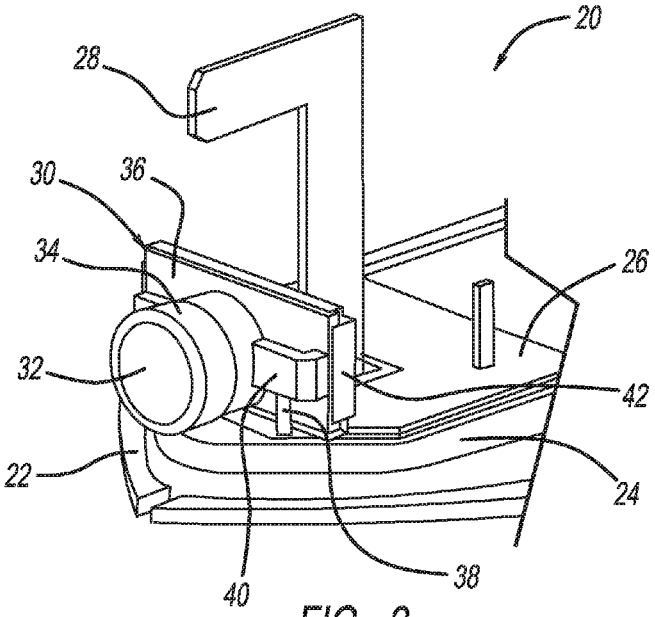
FIG - 2 Prior Art
FIG. 2 is a broken-away isometric view of a portion of a known roof mounted antenna module including an FDM camera.

FIG. 2 is a cut-away, isometric view of a known roof mounted antenna module 20 that can be used as the antenna module 18, where an outer cover of the module 20 has been removed. The antenna module 20 includes an antenna chassis 22 to which the cover would be secured and that would be mounted to the vehicle roof 12 by, for example, bolts. The module 20 also includes a structural mounting ring 24 provided within the antenna chassis 22 to which an antenna platform 26 is secured. One or more antenna elements are mounted to the platform 26 in any suitable configuration. For example, a 4-G or primary long term evolution (LTE) antenna element 28 is mounted to the platform 26 and extends in a vertical direction from the vehicle roof 12.

Further, an FDM camera module 30 is mounted to the platform 26 and includes a camera lens 32, camera optics 34 and a camera circuit board 36. The circuit board 36 includes the various camera processing circuitry, such as a charge coupled device (CCD) that converts light beams to electric signals, digital-to-analog conversion circuitry, power supply, etc., where these electrical devices are coupled to suitable electrical components by lines 38. The camera module 30 also includes a number of metal mounting and support housings 40 including a back plate 42 to which the circuit board 36 is mounted. The module 30 is mounted to the platform 26 so that the camera lens 32 is directed rearward of the vehicle 10 to provide the desired field-of-view. With the camera module 30 in this position, as discussed above, the metal support structure 40 and the back plate 42 interfere with the radiation pattern of the antenna elements in the antenna module 20.

Figure 3:
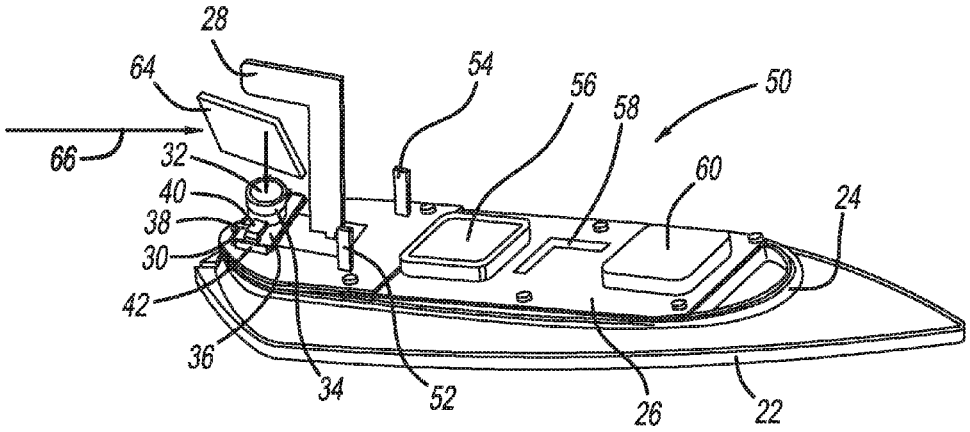
FIG. 3 is an isometric view of a roof mounted antenna module with an outer cover removed showing an FDM camera oriented in a planar manner and including an optical element that corrects the field-of-view of the camera.

FIG. 3 is an isometric view of an antenna module 50 that can be used as the antenna module 18, where like elements to the antenna module 20 are identified by the same reference number, and where the antenna module cover has been removed to expose the components therein. The antenna module 50 includes several antenna elements mounted to the platform 26 including the primary LTE antenna element 28, DSRC antenna elements 52 and 54, a global navigation satellite system (GNSS) patch antenna element 56, such as GPS, a secondary LTE antenna element 58 and a Sirius/XM patch antenna element 60. An AM/FM antenna element is not provided in this particular design, although may be present, and other antenna elements may also be included in the module 50.

In the antenna module 50, the camera module 30 is oriented such that the metal back plate 42 is mounted parallel with the platform 26 so that the lens 32 is directed upward. In this configuration, the metal components of the camera module 30 do not interfere with the radiation pattern of any of the antenna elements 28, 52, 54, 56, 58 and 60 because the profile of the metal components is close to the vehicle roof 12.

Also, in this configuration, the image plane field-of-view of the camera module 30 needs to be redirected rearward of the vehicle 10 so as to be effective for the FDM display. This field-of-view redirection can be provided by any suitable optical element 64, such as a plastic element. Although a single optical element is shown in this non-limiting embodiment, in other embodiments multiple optical elements may be employed. In one embodiment, the optical element 64 is a reflector that is oriented 90° relative to the lens 32 so that light beams 66 received rearward of the vehicle 10 are redirected by the reflector down onto the camera lens 32. In another embodiment, the optical element 64 is a refractive device, such as a prism or diffraction grating lines, that receives the light beams 66 rearward of the vehicle 10 and redirects the light beams 66 downward onto the camera lens 32. In this orientation, the light beams 66 received from the rearward direction of the vehicle 10 are redirected downward into the lens 32 to be focused and processed as an image. The optical element 64 can be mounted to the camera module 30 in any suitable manner using, for example, plastic mounting structures, or can be mounted to the platform 26. Other configurations for the optical element 64 can also be employed consistent with the discussion herein as long as all of the various structures extending significantly above the lens 32 are not made of metal.

Figure 4:
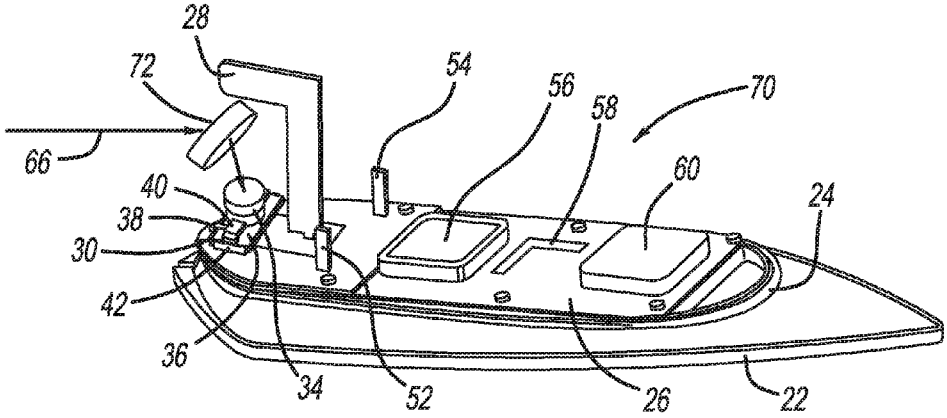
FIG. 4 is an isometric view of a roof mounted antenna module with an outer cover removed showing an FDM camera oriented in a planar manner and including an optical element having focusing capabilities that corrects the field-of-view of the camera.

In an alternate embodiment, the lens 32 can be removed from the camera module 30 and incorporated within the optical element to provide a cost savings. FIG. 4 is an isometric view of an antenna module 70 similar to the module 50, where like elements are identified by the same reference number. In this embodiment, the lens 32 of the camera module 30 has been removed and the optical element 64 has been replaced with an optical element 72. The optical element 72 can be either a reflective element or a refractive element, or multiple optical elements, but would also include the necessary optical curvature or refractive configuration to focus the light beams 66 onto the CCD or other device on the circuit board 36 or other camera component.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna module configured to be mounted to a vehicle, said antenna module comprising:

a platform;

at least one antenna element mounted to the platform;

a camera module mounted to the platform in a horizontal orientation so that an image plane of the camera module is directed in a vertical direction when the antenna module is mounted to the vehicle and where metal components on the camera module do not significantly interfere with a radiation pattern of the at least one antenna element; and an optical element positioned above the platform and mounting locations of the camera module and the at least one antenna element, said optical element being configured to redirect light beams received from a rear of the vehicle to the camera module so as to redirect the camera module image plane.

2. The antenna module according to claim 1 wherein the optical element is a reflector.

3. The antenna module according to claim 1 wherein the optical element is a refractive element.

4. The antenna module according to claim 3 wherein the refractive element is a prism.

5. The antenna module according to claim 1 wherein the camera module includes a lens that focuses the light beams.

6. The antenna module according to claim 1 wherein the optical element provides light beam focusing.

7. The antenna module according to claim 1 wherein the at least one antenna element is a plurality of antenna elements.

8. The antenna module according to claim 7 wherein the plurality of antenna elements are selected from the group consisting of AM/FM antenna elements, Sirius/XM antenna elements, global navigation satellite system (GNSS) antenna elements, cellular antenna elements and dedicated short range communications (DSRC) antenna elements.

9. The antenna module according to claim 1 wherein the antenna module is mounted to a roof of the vehicle.

10. The antenna module according to claim 1 wherein the camera module is part of and provides images for a full display mirror.

11. An antenna module configured to be mounted to a roof of a vehicle, said antenna module comprising:

a platform;

a plurality of antenna elements mounted to the platform;

a camera module that is part of and provides images for a full display mirror, said camera module being mounted to the platform in a horizontal orientation so that an image plane of the camera module is directed vertically from the roof and where metal components in the camera module do not significantly interfere with a radiation pattern of any of the plurality of antenna elements, said camera module including a camera lens; and an optical element positioned above the platform and mounting locations of the camera module and the at least one antenna element, said optical element being configured to redirect light beams received from a rear of the vehicle to the camera lens so as to redirect the camera module image plane.

12. The antenna module according to claim 11 wherein the optical element is a reflector.

13. The antenna module according to claim 11 wherein the optical element is a refractive element.

14. The antenna module according to claim 13 wherein the refractive element is a prism.

15. The antenna module according to claim 11 wherein the plurality of antenna elements are selected from the group consisting of AM/FM antenna elements, Sirius/XM antenna elements, global navigation satellite system (GNSS) antenna elements, cellular antenna elements and dedicated short range communications (DSRC) antenna elements.

16. An antenna module configured to be mounted to a roof of a vehicle, said antenna module comprising:

a platform;

a plurality of antenna elements mounted to the platform;

a camera module that is part of and provides images for a full display mirror, said camera module being mounted to the platform in a horizontal orientation so that an image plane of the camera module is directed vertically from the roof and where metal components in the camera module do not significantly interfere with a radiation pattern of any of the plurality of antenna elements; and an optical element positioned above the platform and mounting locations of the camera module and the at least one antenna element, said optical element being configured to redirect light beams received from a rear of the vehicle to the camera module so as to redirect the camera module image plane, said optical element providing image focusing.

17. The antenna module according to claim 16 wherein the optical element is a reflector.

18. The antenna module according to claim 16 wherein the optical element is a refractive element.

19. The antenna module according to claim 18 wherein the refractive element is a prism.

20. The antenna module according to claim 16 wherein the plurality of antenna elements are selected from the group consisting of AM/FM antenna elements, Sirius/XM antenna elements, global navigation satellite system (GNSS) antenna elements, cellular antenna elements and dedicated short range communications (DSRC) antenna elements.

* * * * *